US006530846B1

(12) United States Patent
Mase

(10) Patent No.: US 6,530,846 B1
(45) Date of Patent: Mar. 11, 2003

(54) GOLF CLUB SET

(75) Inventor: George Thomas Mase, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 09/656,363

(22) Filed: Sep. 6, 2000

(51) Int. Cl.[7] ..... A63B 53/00
(52) U.S. Cl. ..... 473/290; 473/350; 473/291
(58) Field of Search ..... 473/287, 288, 473/289, 290, 291, 350

(56) References Cited

U.S. PATENT DOCUMENTS

| | | | | |
|---|---|---|---|---|
| 3,368,812 | A | | 2/1968 | Baldwin |
| 3,893,670 | A | | 7/1975 | Franchi |
| 3,963,236 | A | | 6/1976 | Mann |
| 4,240,631 | A | | 12/1980 | MacDougall |
| 4,754,970 | A | | 7/1988 | Kobayashi |
| 4,784,390 | A | | 11/1988 | Horgen |
| 4,884,808 | A | | 12/1989 | Retzer |
| 4,971,321 | A | | 11/1990 | Davis |
| 5,228,688 | A | * | 7/1993 | Davis |
| 5,295,686 | A | * | 3/1994 | Lundberg |
| 5,333,859 | A | * | 8/1994 | Teramoto |
| 5,388,826 | A | | 2/1995 | Sherwood |
| 5,413,336 | A | | 5/1995 | Iwanaga |
| 5,433,439 | A | | 7/1995 | Hsien |
| 5,480,145 | A | * | 1/1996 | Sherwood |
| 5,665,009 | A | | 9/1997 | Sherwood |
| 5,716,288 | A | | 2/1998 | Sacco |
| 5,779,559 | A | * | 7/1998 | Eberle |
| 5,865,684 | A | * | 2/1999 | Herber |
| 5,976,029 | A | | 11/1999 | Sherwood |
| 5,984,803 | A | * | 11/1999 | Chappell |

FOREIGN PATENT DOCUMENTS

| | | |
|---|---|---|
| WO | WO 99/39782 | 8/1999 |

* cited by examiner

*Primary Examiner*—Stephen Blau
(74) *Attorney, Agent, or Firm*—Swidler Berlin Shereff Friedman, LLP

(57) ABSTRACT

A set of golf clubs, each of the clubs in the set having substantially the same loft angle and each of the clubs in the set has a shaft length that is different from the other clubs in the set. The loft angle is preferably between about 40 and 50 degrees.

17 Claims, 6 Drawing Sheets

GOLF CLUB SET

FIELD OF THE INVENTION

The present invention relates generally to golf clubs and, more particularly, to a set of golf clubs having similar lofts.

BACKGROUND OF THE INVENTION

Iron type golf clubs generally include a front face, a top line and a sole. The front face interfaces with and strikes the golf ball. A plurality of score lines or grooves are positioned on the face to assist in imparting spin. The top line is generally configured to have a particular look to the golfer and to provide weight. The sole of the golf club is particularly important to the golf shot because it contacts and interacts with the ground during the golf shot.

Wood type golf clubs are hollow clubs that generally include a front face, a crown and a sole. Again, the front face interfaces with and strikes the golf ball and includes a plurality of score lines or grooves. The crown is generally configured to have a particular look to the golfer. The sole contacts and interacts with the ground during the golf shot.

Prior golf clubs have included a variety of configurations to provide various benefits. However, golf club sets have a plurality clubs of different lofts to allow a player to hit the ball different distances. For example, sets of irons generally include 3 iron, which has a loft of about 22 degrees, through pitching wedge, which has a loft of about 48 degrees, with each club in between having about 3–4 degrees of loft difference from the next club in the set. Woods similarly come in a variety of lofts. For example, drivers are available in lofts from about 5 degrees through about 13 degrees. A 3-wood, generally the next wood in a set of woods, has a loft of about 13–15 degrees, and 4- and 5-woods generally have lofts of about 18 and 21 degrees, respectively.

The present invention is directed to an improved golf club set that is particularly useful for players with lower swing speeds that have trouble hitting clubs with lower lofts.

SUMMARY OF THE INVENTION

The present invention is directed to a set of golf clubs where each of the clubs in the set has substantially the same loft angle and each of the clubs in the set has a shaft length that is different from the other clubs in the set. In a preferred embodiment, the loft angle is greater than 40 degrees and, more preferably, the loft angle is between about 40 and 50 degrees. Most preferably, the set includes a plurality of iron-type clubs having substantially similar lofts in the range of about 40 to 50 degrees. Preferably, each of the shaft lengths is different that the other shaft lengths by at least about 0.25 inches. More preferably, each of the shaft lengths is different that the other shaft lengths by at least 0.5 inches and, most preferably, each of the shaft lengths is different that the other shaft lengths by about 1 inch.

In one embodiment, each of clubs has a center of gravity height from the ground that is different from the other clubs in the set. Preferably, the center of gravity height from the ground progressively increases for each club with an increase in shaft length. However, in another embodiment, the center of gravity height from the ground progressively decreases for each club with an increase in shaft length. In a preferred embodiment, the center of gravity height from the ground changes by at least about 0.005 inches. It is preferred that the center of gravity height from the ground is between about 0.6 and about 0.9 inches.

The present invention is also directed to a set of golf clubs where each of the clubs in the set has substantially the same loft angle and each of clubs has a center of gravity distance from the leading edge that is different from the other clubs in the set. In a first embodiment, the center of gravity distance from the leading edge progressively increases for each club with an increase in shaft length. One particular embodiment of this invention can include hollow clubs with longer shafts and perimeter weighted, iron-type clubs with shorter shafts. Another embodiment of the invention includes a center of gravity distance from the leading edge that progressively decreases for each club with an increase in shaft length.

In one embodiment, each of clubs has a center of gravity distance from the hosel axis that is different from the other clubs in the set. In a first embodiment, the center of gravity distance from the hosel axis progressively increases for each club with an increase in shaft length. Preferably, the center of gravity distance from the leading edge progressively increases by at least about 0.005 inches between clubs. In another embodiment, the center of gravity distance from the leading edge progressively decreases for each club with an increase in shaft length. Preferably, the center of gravity distance from the leading edge progressively decreases by at least about 0.005 inches between clubs. In a particularly preferred embodiment, the center of gravity distance from the leading edge is between about 0.4 and about 0.6 inches.

In one embodiment, each of clubs has a toe height that is different from the other clubs in the set. Preferably, the toe height progressively decreases for each club with an increase in shaft length such that the longer shaft irons have a shorter profile and less weight. Another embodiment of the invention includes a toe height that progressively increases for each club with an increase in shaft length. It is preferred that the toe height change be at least about 0.01 inches.

In one embodiment, each of clubs has a par height that is different from the other clubs in the set. Preferably, the par height progressively decreases for each club with an increase in shaft length such that the longer shaft irons have a shorter profile. Another embodiment of the invention includes a par height that progressively increases for each club with an increase in shaft length. It is preferred that the par height change be at least about 0.01 inches.

In still another embodiment, each of clubs has a face length that is different from the other clubs in the set. In one embodiment, the face length progressively decreases for each club with an increase in shaft length. In another embodiment, the face length progressively increases for each club with an increase in shaft length.

In another embodiment, each of clubs has an offset that is different from the other clubs in the set. In a preferred embodiment, the offset progressively increases for each club with an increase in shaft length. In another embodiment, the offset progressively decreases for each club with an increase in shaft length. It is preferred that the offset changes by at least 0.002 inches. Preferably, the offset is no greater than about 0.2 inches. In another preferred embodiment, the offset is between about 0.3 and about 0.8 inches.

DESCRIPTION OF THE PREFERRED EMBODIMENT

Figure 1:
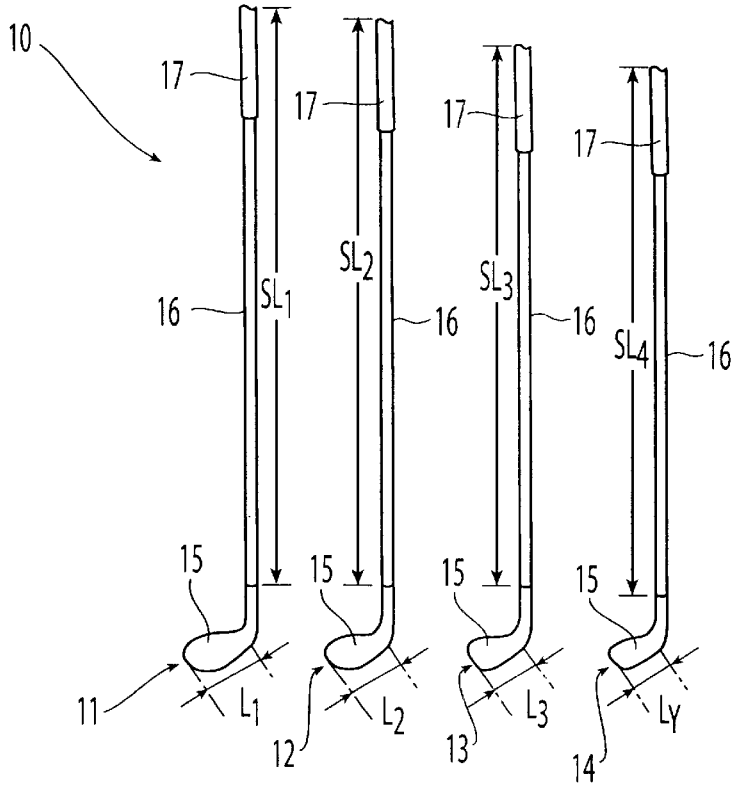
FIG. 1 is a front view of a set of clubs according to the present invention.

Referring to FIG. 1, the present invention is directed to a set of golf clubs 10 where each of the clubs in the set 11, 12, 13, and 14 has substantially the same loft angle. Each of the clubs 11, 12, 13, and 14 includes a club head 15, a shaft 16, and preferably a grip 17. According to the present invention, each of the clubs 11, 12, 13 and 14 in the set 10 has a shaft length $SL_1$, $SL_2$, $SL_3$, and $SL_4$ that is different from the other clubs in the set. In other words, shaft length $SL_1$ is greater than shaft length $SL_2$, which is greater than shaft length $SL_3$, which is greater than shaft length $SL_4$. Preferably, each of the shaft lengths SL is different that the other shaft lengths by at least 0.25 in and, more preferably, each of the shaft lengths is different that the other shaft lengths by about 0.5 in or more.

Figure 2:
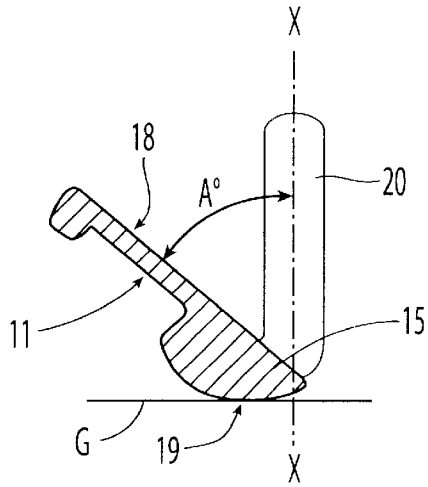
FIG. 2 is a cross-sectional view of one club from the set of clubs in FIG. 1.
Figure 3:
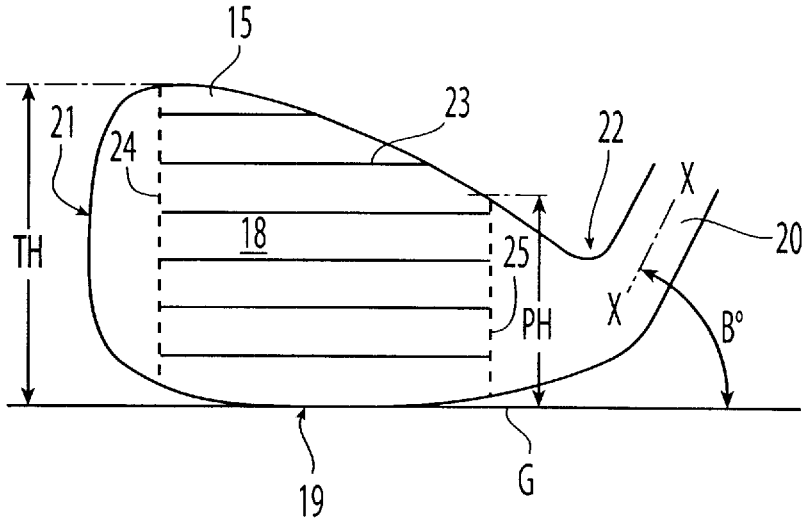
FIG. 3 is a front view of the club in FIG. 2.

Referring to FIGS. 2 and 3, a golf club 11 of the set 10 includes the head 15 with a face 18 for striking the ball and a sole 19 for interacting with the ground G. The club 11 also includes a hosel 20 with a central axis XX. The face 18 and a vertical plane including the hosel axis XX form a loft angle A. The loft angle A for each of the clubs in the set is preferably greater than 40 degrees and, more preferably, the loft angle A is between about 40 and 50 degrees for the iron-type clubs as shown in this embodiment. Each of the clubs also includes a toe 21 and a heel 22 with a plurality of grooves or score lines 23 extending therebetween. The clubs have blade heights that are best measured in the plane of the face at the toe and par locations, 24 and 25, respectively. The toe location 24 is at the toe-end of the score lines 23, and the par location 25 is at the heel-end of the score lines 23. Each club includes a toe height TH measured at the toe location and a par height PH measured at the par location. Each club also includes a lie angle B, which is the angle between the ground and the hosel axis a the heel-end of the club when the club sole 19 is flat on the ground G.

Figure 4:
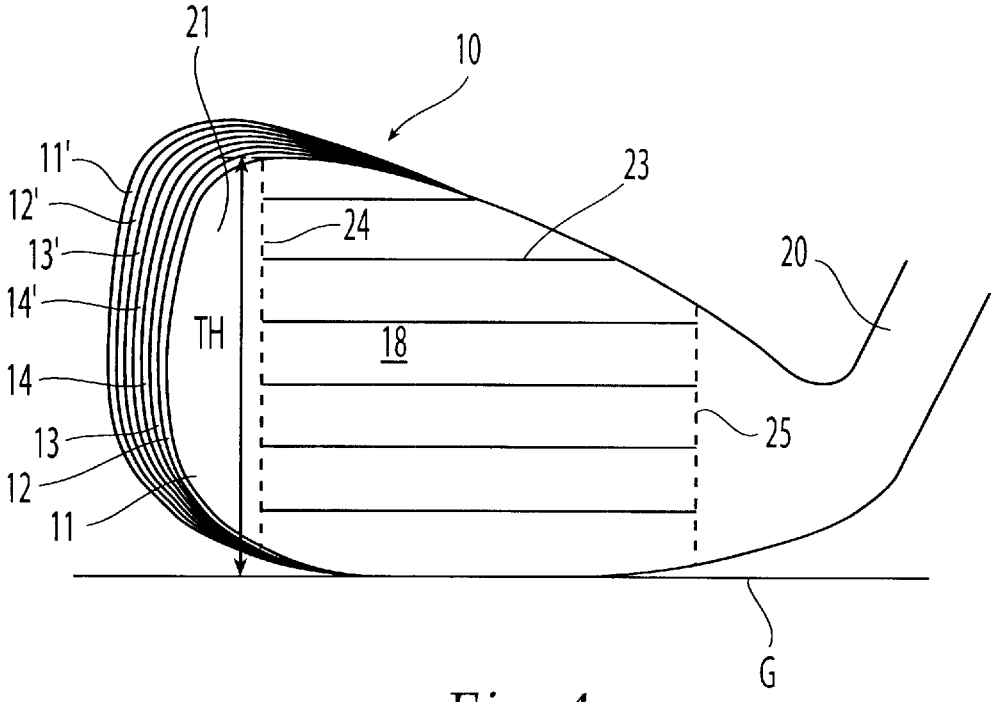
FIG. 4 is a front plan view of a golf club set according to the present invention.

Referring to FIG. 4, one set of clubs 10 is comprised of a plurality of clubs 11,12, 13, and 14, where each of the clubs 11, 12, 13, and 14 in the set 10 has substantially the same loft angle and each of clubs has a toe height TH that is different from the other clubs in the set. Preferably, the toe height TH progressively decreases for each club 11, 12, 13, and 14 with an increase in shaft length $SL_1$, $SL_2$, $SL_3$, and $SL_4$. Thus, in this embodiment, the longest iron has the shortest toe height. Preferably, the toe height changes by at least 0.01 inches. Another embodiment of the invention 11', 12', 13', and 14' includes a plurality of clubs with the toe height TH that progressively increases for each club with an increase in shaft length $SL_1$, $SL_2$, $SL_3$, and $SL_4$, respectively, such that the longer shaft irons have a greater profile. Thus, in this preferred embodiment, the longest shafted club has the longest toe height.

Figure 5:
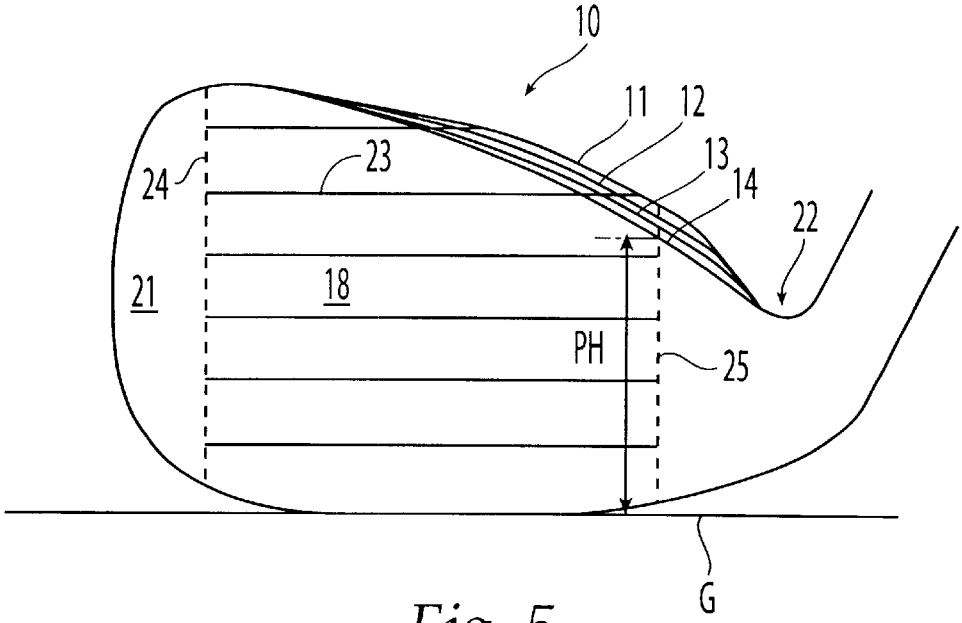
FIG. 5 is a front plan view of a golf club set according to the present invention.

Referring to FIG. 5, another preferred embodiment of the present invention is a set of golf clubs 10 where each of the clubs 11, 12, 13, and 14 in the set has substantially the same loft angle, e.g., between 40 and 50 degrees, and each of clubs 11, 12, 13, and 14 has a par height PH that is different from the other clubs in the set. Preferably, the par height PH progressively decreases for each club with an decrease in shaft length SL such that the shorter shaft irons have a shorter profile. However, in another preferred embodiment of the invention, the par height PH progressively increases for each club with an decrease in shaft length SL such that the longer shaft irons have a shorter profile. Preferably, the difference in par height between clubs is at least 0.01 inches.

Figure 6:
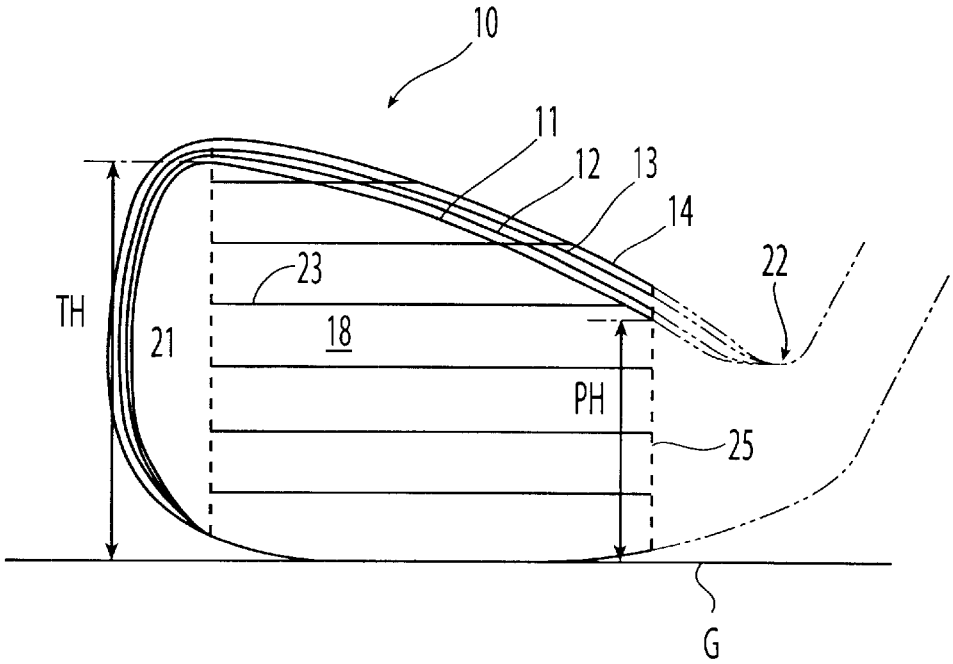
FIG. 6 is a front plan view of a golf club set according to the present invention.
Figure 7:
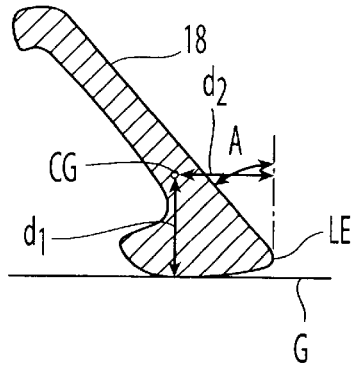
FIGS. 7–10 are cross-sectional views of a set of clubs according to the present invention.
Figure 8:
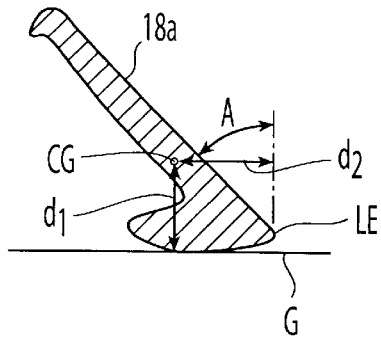
Figure 9:
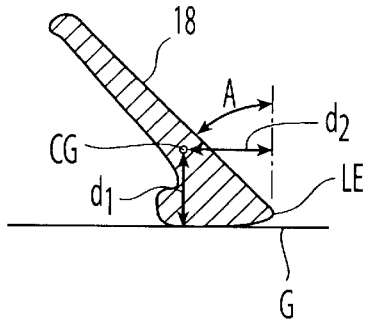

Referring to FIG. 6, another preferred embodiment of the present invention is a set of golf clubs 10 where each of the clubs 11, 12, 13 and 14 in the set has substantially the same loft angle, e.g., between 40 and 50 degrees, and each of clubs 11, 12, 13, and 14 has a par height PH and toe height TH that is different from the other clubs in the set. Preferably, the par height PH and toe height TH progressively increase for each club with an decrease in shaft length SL such that the longer shaft irons have a shorter profile. Preferably, the difference in par height PH between clubs is at least 0.01 inches and the difference in toe height TH between clubs is at least 0.01 inches. In another preferred embodiment of the invention, the par height PH and toe height TH progressively increase for each club with an decrease in shaft length SL such that the shorter shaft irons have a shorter profile.

Figure 10:
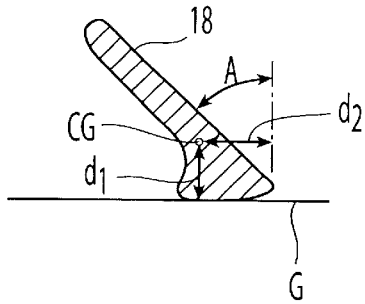

FIGS. 7–10 disclose cross-sections of clubs that comprise yet another embodiment of the present invention. In this embodiment each club in the set of golf clubs has substantially the same loft angle A and each of clubs has a center of gravity height $d_1$, from the ground that is different from the other clubs in the set. Preferably, the center of gravity height $d_1$progressively increases for each club with an increase in shaft length. For example, FIG. 7 can represent the longest club in the set and the club has the greatest center of gravity height $d_1$. More particularly, the center of gravity height $d_1$ ranges from about 0.6 to about 0.9 inches and preferably each center of gravity height $d_1$ is different from each of the other center of gravity heights $d_1$ by at least 0.005 inches. In a most preferred embodiment, $d_1$ has a nominal height of about 0.79 inches. In another embodiment, the center of gravity height $d_1$ from the ground progressively decreases for each club with an increase in shaft length. Thus, in this embodiment, the club shown in FIG. 10 is the longest club in the set and has the shortest center of gravity height $d_1$.

FIGS. 7–10 also disclose cross-sections of clubs that have substantially the same loft angle A and each of the clubs has a center of gravity distance $d_2$ from the leading edge LE that is different from the other clubs in the set. Preferably, the center of gravity distance $d_2$ progressively increases for each club with an increase in shaft length. For example, FIG. 7 can represent the longest club in the set and the club has the greatest center of gravity distance $d_2$. In a preferred embodiment, the center of gravity distance $d_2$ is between about 0.4 and about 0.6 inches and, most preferably, about 0.55 inches. More particularly, the center of gravity distance $d_2$ is preferably different from each of the other center of gravity distances $d_2$ by at least 0.005 inches. In another embodiment, the center of gravity distance $d_2$ from the leading edge LE progressively decreases for each club with an increase in shaft length. Thus, in this embodiment, the club shown in FIG. 10 is the longest club in the set and has the shortest center of gravity distance $d_2$.

Figure 11:
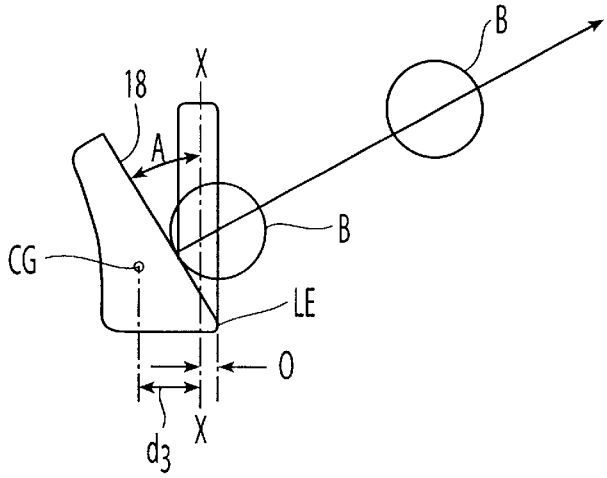
FIGS. 11–13 are toe side plan views of a set of clubs according to the present invention.
Figure 12:
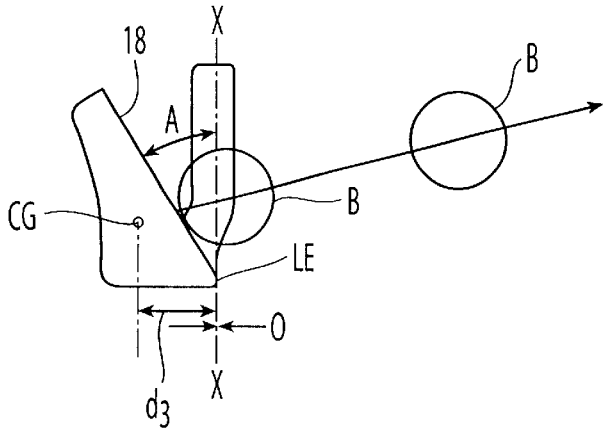
Figure 13:
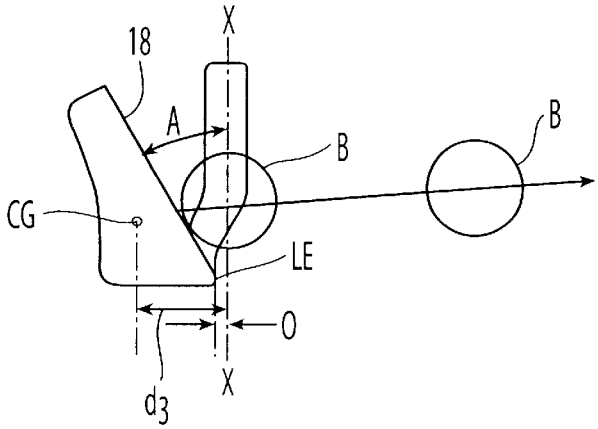

FIGS. 11–13 discloses another embodiment of a set of golf clubs where each of the clubs in the set has substantially the same loft angle A and each of clubs has a center of gravity distance $d_3$ from the shaft center line XX that is different from the other clubs in the set. As shown in FIGS.

11–13, the offset O through the set varies from a negative offset in FIG. 11 to no offset in FIG. 12 and a positive offset in FIG. 13. In a preferred embodiment, the center of gravity distance $d_3$ is between about 0.3 and about 0.8 inches. Preferably, the offset is no greater than about 0.2 inches and varies by at least 0.002 inches for the next club in the set. In this embodiment, the center of gravity distance $d_3$ from the shaft center line XX increases as the offset progresses from a negative offset to a positive offset. In a first embodiment, the center of gravity distance from the shaft center line XX progressively increases for each club with an increase in shaft length. In another embodiment, the center of gravity distance from the shaft center line XX progressively increases for each club with a decrease in shaft length. One particular embodiment of this invention can include hollow clubs with longer shafts and perimeter weighted, iron-type clubs with shorter shafts. Another embodiment of the invention includes a center of gravity distance from the leading edge that progressively decreases for each club with an increase in shaft length.

Figure 14:
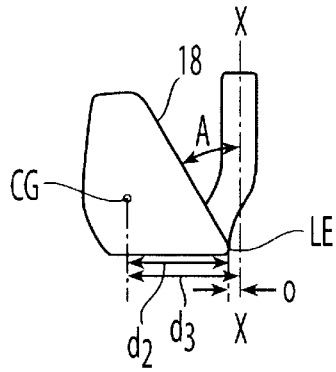
FIGS. 14–17 are toe side plan views of a set of clubs according to the present invention.
Figure 15:
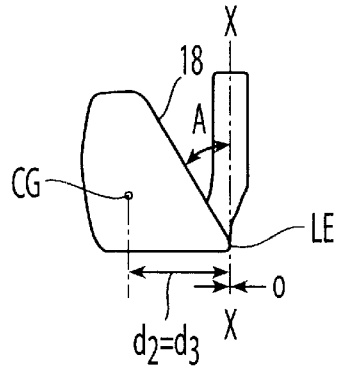

Referring to FIGS. 13–17, another embodiment of the present invention includes a set of golf clubs where each of the clubs in the set has substantially the same loft angle A and each of clubs has a center of gravity distance $d_2$ from the leading edge LE that is different from the other clubs in the set while the center of gravity distance $d_3$ from the shaft center line XX remains substantially the same. As shown in FIGS. 13–14, the offset O through the set can vary from a positive offset in FIG. 13 to no offset in FIG. 14. Preferably, the offset varies by at least 0.002 inches for the next club in the set. In one embodiment, the $d_2$ is less than $d_3$ when a particular club in the set has a positive offset and progressively decreases to become substantially the same as $d_3$ when a particular club in the set has no offset. In one embodiment, the progressive change in $d_2$ occurs as the shaft length progressively increases. In another embodiment, the progressive change in $d_2$ occurs as the shaft length progressively decreases.

Figure 16:
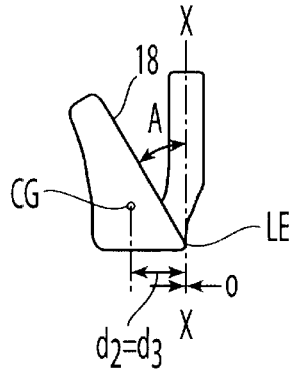
Figure 17:
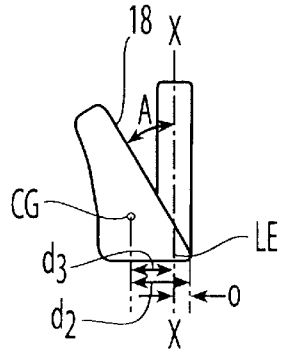

Referring to FIGS. 16–17, the offset O through the set can vary from no offset in FIG. 16 to a negative offset in FIG. 17. Preferably, the offset varies by at least 0.002 inches for the next club in the set. In one embodiment, the $d_2$ is substantially the same as $d_3$ when a particular club in the set has no offset and progressively increases to become greater than $d_3$ when a particular club in the set has a negative offset. In one embodiment, the progressive change in $d_2$ occurs as the shaft length progressively increases. In another embodiment, the progressive change in $d_2$ occurs as the shaft length progressively decreases.

The present invention is further directed to a set of golf clubs where each of the clubs in the set has substantially the same loft angle and each of clubs has an offset that is different from the other clubs in the set the offset progressively increases for each club with an increase in shaft length. Even more preferably, the offset through the set increases with a decrease in the toe height. In another embodiment, the offset progressively decreases for each club with an increase in shaft length.

The present invention is further directed to a set of golf clubs where each of the clubs in the set has substantially the same loft angle and each of clubs has a face length that is different from the other clubs in the set. In one embodiment, the face length progressively increases for each club with an increase in shaft length. In a preferred embodiment, the toe height and par height progressively decrease with the increase in face length and shaft length. In another embodiment, the face length progressively decreases for each club with an increase in shaft length.

EXAMPLES

Example I

A set of golf clubs was constructed having progressively decreasing shaft length while having substantially the same loft angle A. The clubs are designated mid-mashie, mashie, niblick-mashie, and niblick. The lie angle and clubhead mass were increased and the offset was decreased as shaft length decreased. The values for the above-mentioned properties are set forth in Table I below.

TABLE I

| Club | Length (in) | Loft (°) | Lie (°) | Offset (in) | Head mass (g) |
|---|---|---|---|---|---|
| Mid-mashie | 38 | 42 | 60 | 0.20 | 242 |
| Mashie | 37 | 44 | 61 | 0.18 | 254 |
| Niblick-mashie | 36 | 46 | 62 | 0.16 | 268 |
| Niblick | 35 | 46 | 63 | 0.14 | 284 |

The set of clubs constructed as described above was tested for a variety of properties, such as golf ball velocity, launch angle of the ball off the clubface, golf ball spin, and golf ball carry. The results are set forth in Table II below.

TABLE II

| Club | Velocity (mph) | Launch angle (°) | Spin (rpm) | Carry (yd) |
|---|---|---|---|---|
| Mid-mashie | 80.6 | 27.0 | 4490 | 117 |
| Mashie | 76.7 | 28.2 | 4588 | 109 |
| Niblick-mashie | 72.7 | 29.5 | 4687 | 101 |
| Niblick | 68.8 | 29.5 | 4687 | 90 |

As Table II above clearly demonstrates, the set of golf clubs prepared according to one embodiment of the present invention provided almost a 30-yard distance difference over a range of four clubs having substantially the same clubhead loft. A 10-yard difference between successive irons is a desirable characteristic of a golf club set and is common among recreational golfers.

Example II

A second set of golf clubs prepared according to one embodiment of the invention was constructed having progressively decreasing shaft length while having substantially the same loft angle A. The clubs are designated mid-mashie, mashie, niblick-mashie, and niblick. The lie angle and clubhead mass were increased and the offset decreased as shaft length decreased. The values for the above-mentioned properties are set forth in Table III below.

TABLE III

| Club | Length (in) | Loft (°) | Lie (°) | Offset (in) | Head mass (g) |
|---|---|---|---|---|---|
| Mid-mashie | 38 | 42 | 60 | 0.20 | 242 |
| Mashie | 37.5 | 44 | 61 | 0.18 | 254 |
| Niblick-mashie | 37 | 46 | 62 | 0.16 | 268 |
| Niblick | 36.5 | 46 | 63 | 0.14 | 284 |

The set of clubs constructed as described above was tested for a variety of properties, such as golf ball velocity, launch angle of the ball off the clubface, golf ball spin, and golf ball carry. The results are set forth in Table II below.

TABLE VI

| Club | Velocity (mph) | Launch angle (°) | Spin (rpm) | Carry (yd) |
|---|---|---|---|---|
| Mid-mashie | 80.6 | 27.0 | 4490 | 117 |
| Mashie | 78.6 | 28.2 | 4588 | 115 |
| Niblick-mashie | 76.7 | 29.5 | 4687 | 112 |
| Niblick | 74.7 | 29.5 | 4687 | 106 |

The term "about," as used herein in connection with one or more numbers or numerical ranges, should be understood to refer to all such numbers, including all numbers in a range.

It will be understood that each of the clubs disclosed in Tables I–IV and FIGS. 1–17 above are representative of clubs according to the present invention and that the clubs could be combined with other clubs to form additional sets. Based on the teachings herein and a player's preference, one of ordinary skill can create many different sets that are within the scope of the invention. Thus, the above disclosure of sets is merely meant to provide examples of preferred embodiments and not limit the scope of the claims below. Furthermore, while each of the sets above include four or more clubs, it is intended that the word set mean three or more clubs, but that a set does not mean a group of clubs that the user is expected to pick one of.

What is claimed is:

1. A set of golf clubs, each of the clubs in the set having substantially the same loft angle and each of the clubs in the set having a shaft length that is different from the other clubs in the set, wherein each of the clubs has a toe height that is different from the other clubs in the set.

2. The set of golf clubs of claim 1, wherein the toe height progressively increases for each club with an increase in shaft length.

3. The set of golf clubs of claim 2, wherein the toe height progressively increases by at least about 0.01 inches with an increase in shaft length.

4. The set of golf clubs of claim 1, wherein the toe height progressively decreases for each club with an increase in shaft length.

5. The set of golf clubs of claim 4, wherein the toe height progressively decreases by at least about 0.01 inches with an increase in shaft length.

6. The set of golf clubs of claim 1, wherein each of the clubs has an offset that is different from the other clubs in the set.

7. The set of golf clubs of claim 6, wherein the offset progressively increases for each club with an increase in shaft length.

8. The set of golf clubs of claim 7, wherein the offset increases by at least about 0.002 inches with an increase in shaft length.

9. The set of golf clubs of claim 6, wherein the offset progressively decreases for each club with an increase in shaft length.

10. The set of golf clubs of claim 9, wherein the offset decreases by at least about 0.002 inches with an increase in shaft length.

11. The set of golf clubs of claim 6, wherein the offset is no greater than about 0.2 inches.

12. The set of golf clubs of claim 6, wherein the offset is between about 0.3 and about 0.8 inches.

13. A set of golf clubs, each of the clubs in the set having substantially the same loft angle and each of the clubs in the set having a shaft length that is different from the other clubs in the set, wherein each of the clubs has a par height that is different from the other clubs in the set.

14. The set of golf clubs of claim 13, wherein the par height progressively increases for each club with an increase in shaft length.

15. The set of golf clubs of claim 14, wherein the par height increases by at least about 0.01 inches with an increase in shaft length.

16. The set of golf clubs of claim 13, wherein the par height progressively decreases for each club with an increase in shaft length.

17. The set of golf clubs of claim 16, wherein the par height decreases by at least about 0.01 inches with an increase in shaft length.

* * * * *